US009811020B2

(12) United States Patent
Vella et al.

(10) Patent No.: US 9,811,020 B2
(45) Date of Patent: Nov. 7, 2017

(54) STABILIZING POLYMERS TO CONTROL PASSIVE LEAKING OF FUNCTIONAL MATERIALS FROM DELIVERY MEMBERS

(71) Applicant: Xerox Corporation, Norwalk, CT (US)

(72) Inventors: Sarah J Vella, Milton (CA); Nan-Xing Hu, Oakville (CA); Yu Liu, Mississauga (CA)

(73) Assignee: XEROX CORPORATION, Norwalk, CT (US)

( * ) Notice: Subject to any disclaimer, the term of this patent is extended or adjusted under 35 U.S.C. 154(b) by 847 days.

(21) Appl. No.: 13/783,665

(22) Filed: Mar. 4, 2013

(65) Prior Publication Data

US 2014/0249005 A1 Sep. 4, 2014

(51) Int. Cl.

| | |
|---|---|
| ***B05C 1/08*** | (2006.01) |
| ***G03G 15/02*** | (2006.01) |
| ***G03G 21/00*** | (2006.01) |

(52) U.S. Cl.

CPC ..... *G03G 15/0233* (2013.01); *G03G 15/0208* (2013.01); *G03G 15/0216* (2013.01); *G03G 21/0094* (2013.01)

(58) Field of Classification Search

None

See application file for complete search history.

(56) References Cited

U.S. PATENT DOCUMENTS

| | | | | |
|---|---|---|---|---|
| 4,078,948 | A * | 3/1978 | Martellock | G03G 15/2025 148/251 |
| 4,435,074 | A | 3/1984 | Midorikawa et al. | |
| 4,996,125 | A | 2/1991 | Sakaguchi et al. | |
| 5,460,911 | A | 10/1995 | Yu et al. | |
| 7,881,651 | B2 | 2/2011 | Watanabe | |
| 8,034,525 | B2 | 10/2011 | Matsumoto et al. | |
| 8,036,577 | B2 | 10/2011 | Tokutake et al. | |
| 8,600,281 | B2 | 12/2013 | Hu et al. | |
| 8,676,089 | B2 | 3/2014 | Vella et al. | |
| 8,768,234 | B2 | 7/2014 | Vella et al. | |
| 8,774,696 | B2 | 7/2014 | Liu et al. | |
| 8,805,241 | B2 | 8/2014 | Hu et al. | |
| 8,805,262 | B2 | 8/2014 | McGuire et al. | |
| 8,831,501 | B2 | 9/2014 | Vella et al. | |
| 8,903,297 | B2 | 12/2014 | McGuire et al. | |

(Continued)

FOREIGN PATENT DOCUMENTS

| | | | |
|---|---|---|---|
| JP | 11-212398 | | 6/1999 |
| JP | 2009062493 | A * | 3/2009 |

OTHER PUBLICATIONS

Formulating Silicone Adhesives Gels and Sealants John H. MacMillan UCT (2008).*

(Continued)

*Primary Examiner* — Kenneth Stachel

(74) *Attorney, Agent, or Firm* — MH2 Technology Law Group LLP

(57) ABSTRACT

A delivery member for use in an image forming apparatus. The delivery member has a support member and a first layer disposed on the support member. The first layer includes a cross-linked elastomeric matrix, a stabilizing polymer comprising a polysiloxane backbone, and a functional material. Coating mixtures for preparing such delivery members having a first layer. Image forming apparatuses containing such delivery members.

20 Claims, 10 Drawing Sheets

(56) References Cited

U.S. PATENT DOCUMENTS

| | | | | |
|---|---|---|---|---|
| 2005/0036808 | A1* | 2/2005 | Abe | G03G 15/2025 399/325 |
| 2009/0028618 | A1 | 1/2009 | Kabata et al. | |
| 2010/0189461 | A1 | 7/2010 | Shintani et al. | |
| 2011/0002064 | A1 | 1/2011 | Nakagawa et al. | |
| 2011/0014557 | A1 | 1/2011 | Kim et al. | |
| 2012/0201585 | A1* | 8/2012 | Hu | G03G 21/0094 399/346 |
| 2014/0141361 | A1 | 5/2014 | Liu et al. | |

OTHER PUBLICATIONS

English machine translation of JP 2009062493 (2009).*
English Translation of JP 11-212398 published Jun. 8, 1999.

* cited by examiner

STABILIZING POLYMERS TO CONTROL PASSIVE LEAKING OF FUNCTIONAL MATERIALS FROM DELIVERY MEMBERS

BACKGROUND

Embodiments herein relate generally to image forming apparatuses (e.g., electrophotographic apparatuses and printers) and components for use therein. Some embodiments are drawn to improved delivery members for delivery (directly or indirectly) of a functional material to the surface of an imaging member (e.g., photoreceptor) in an image forming apparatus to reduce printing defects and extend the useful lifespan of the imaging member.

In electrophotographic printing, the charge retentive surface/imaging member, also known as a photoreceptor, is electrostatically charged by a charging unit (e.g., a bias charge member), and then exposed to a light pattern of an original image to selectively discharge the surface in accordance therewith. The resulting pattern of charged and discharged areas on the photoreceptor form an electrostatic charge pattern, known as a latent image, conforming to the original image. The latent image is developed by contacting it with toner or developer.

Long life photoreceptors can result in significant run-cost reductions. Improvement of long life photoreceptors has included the development of low wear protective overcoat layers. These protective overcoat layers can help dramatically reduce surface wear of imaging members. However, these layers can also introduce a host of unwanted issues caused by the poor interaction between a cleaning blade and the overcoat layer and increased lateral charge migration (LCM). The overcoats can be associated with extremely high initial torque and can result in print defects, poor cleaning, cleaning blade damage/failure and cleaning blade flip, and, in some cases, high initial torque can prevent the imaging member from turning and can cause a motor fault. High torque can induce mechanical stress and vibration in the cleaning blade, which can, in turn, result in deformation and acoustic squeaking of the blade. This can damage the blade surface enough to permit permanent toner contamination of the imaging member. The contamination is often characterized by lines of toner around the circumference of the imaging member that correlate with the damaged areas of the cleaning blade.

The performance of overcoated imaging members can be improved by applying a thin film of a functional material/lubricant (e.g., paraffin oil) using an extrinsic delivery system (such as a delivery member) to address both the LCM and friction/torque problems. The thin film of functional material can act to lubricate a cleaning blade. Examples of methods and apparatuses related to application of functional materials to address these problems are described in copending U.S. patent application Ser. No. 13/020,738 (U.S. Publication No. 20120201585); Ser. No. 13/192,215 (U.S. Publication No. 20130028636); Ser. No. 13/192,252 (U.S. Publication No. 20130028637); Ser. No. 13/279,981; and Ser. No. 13/437,472, the specifications of which are incorporated herein by reference in their entireties.

An issue related to certain delivery members having an outer polydimethylsiloxane (PDMS) matrix that deliver a paraffin oil to an imaging member is that the paraffin oil can passively diffuse from the PDMS matrix (even without being in contact with another object, such as a bias charge roll (BCR)). This passive diffusion of the paraffin oil out of the delivery member can cause the paraffin oil to pool against a BCR or imaging member when an image forming apparatus sits idle (e.g., as when turned off overnight). The passive leaking of paraffin oil from a delivery member is detrimental to an image forming apparatus (e.g., printer), because over-delivery of paraffin oil increases contamination and causes print defects (e.g., streaking or lack of toner development); and consumes/wastes the supply of paraffin oil.

It would be desirable to maximize the amount of functional material (such as paraffin oil) stored in a delivery member in order to maximize the delivery member's lifetime. However, passive diffusion of functional material is greater at higher loadings of functional material relative to the elastomer matrix in delivery members, such as in delivery members having high loadings of paraffin oil dispersed in a PDMS matrix. Thus, it would be desirable to reduce or minimize passive leaking of functional material from delivery members.

SUMMARY

Certain embodiments are drawn to delivery members for use in image forming apparatuses. The delivery members include a support member and a first layer disposed on the support member. The first layer has a cross-linked elastomeric matrix, a stabilizing polymer comprising a polysiloxane backbone, and a functional material.

Some embodiments are drawn to a coating mixture for a delivery member containing an elastomer capable of being cross-linked, a stabilizing polymer comprising a polysiloxane backbone, and a functional material.

Certain embodiments are directed to image forming apparatuses that include an imaging member having a charge retentive surface, a charging unit for applying an electrostatic charge on the imaging member; and a delivery member disposed in contact with a surface of the imaging member or a surface of the charging unit. The delivery member has a support member, and a first layer, including a cross-linked elastomeric matrix, a stabilizing polymer comprising a polysiloxane backbone, and a functional material, that is disposed on the support member.

paraffin oil:MHOMS 2:1:0.5, and c) PDMS:paraffin oil: pTDMS 2:1:0.25 in contact with a bias charge roll (BCR) for 24 hours.

Figure 6:
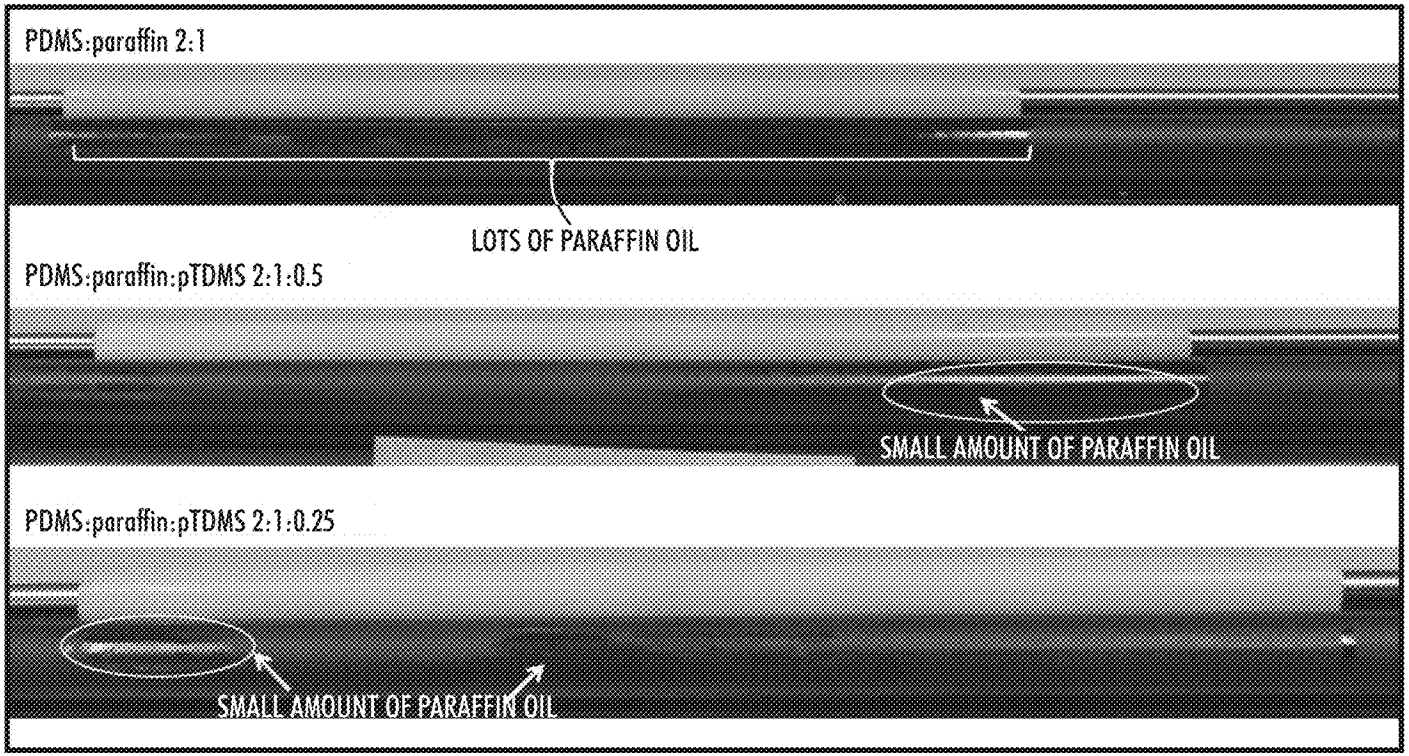

FIG. 6 shows photos of delivery rollers prepared with formulations by weight: PDMS:paraffin oil 2:1, PDMS: paraffin oil:pTDMS 2:1:0.5, and PDMS:paraffin oil:pTDMS 2:1:0.25 in contact with a bias charge roll (BCR) for about 5 days.

Figure 7:
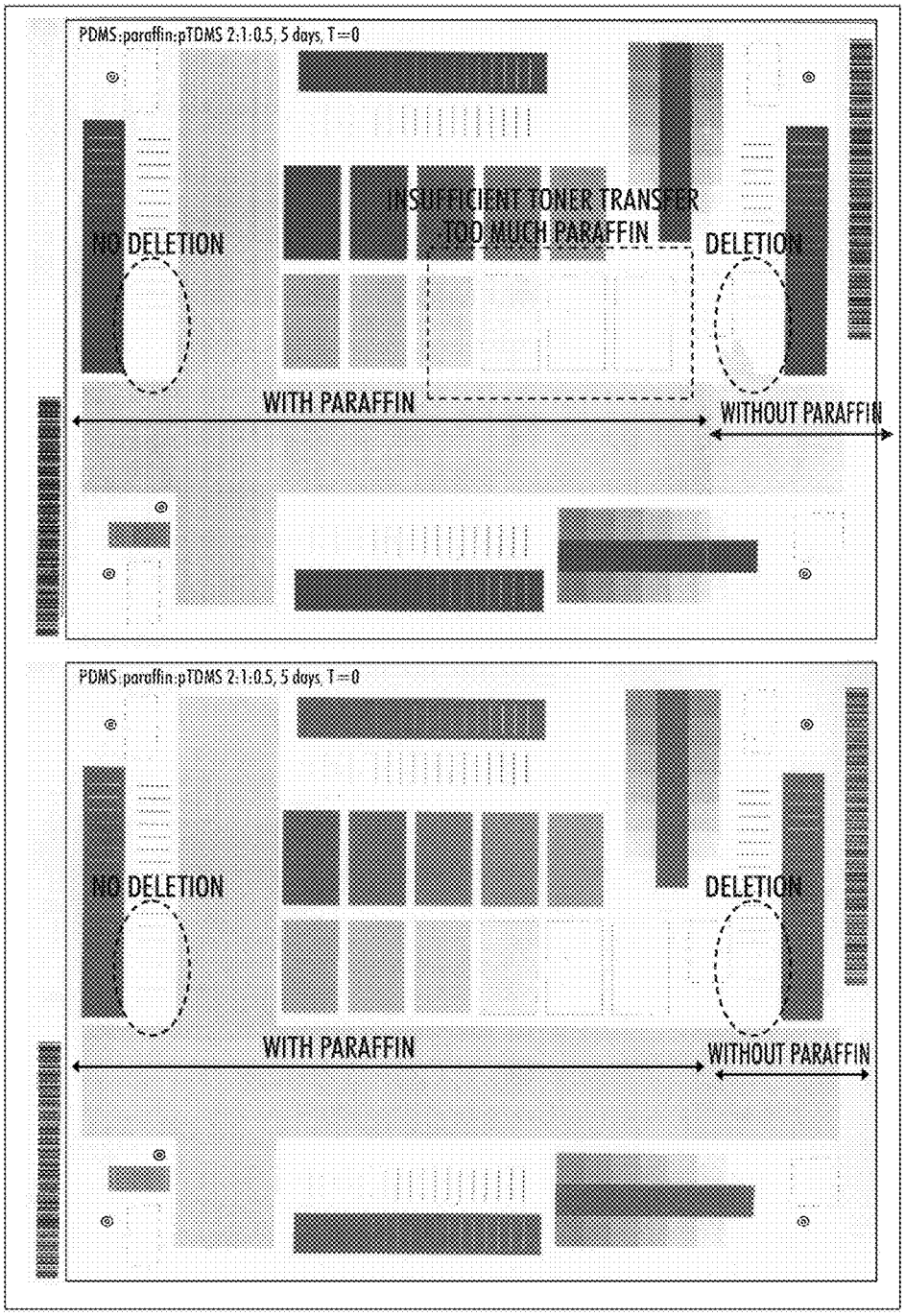

FIG. 7 depicts print tests performed with an image forming apparatus having a delivery roller comprising by weight PDMS:paraffin oil 2:1, and PDMS:paraffin oil:pTDMS 2:1: 0.5 after aging about 24 hours and 0 prints.

Figure 8:
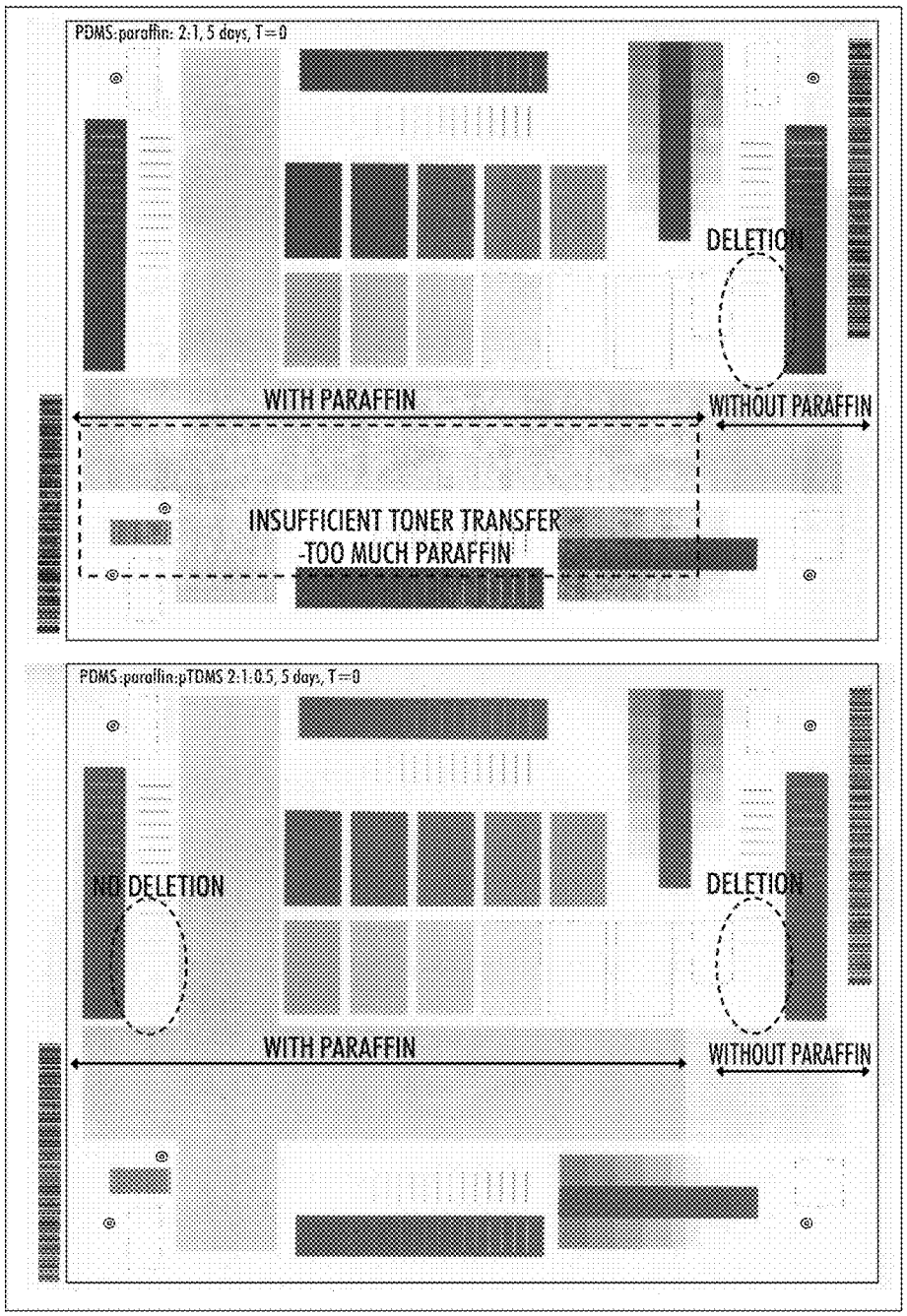

FIG. 8 depicts print tests performed with an image forming apparatus having a delivery roller comprising by weight PDMS:paraffin oil 2:1, and PDMS:paraffin oil:pTDMS 2:1: 0.5 after aging about 5 days and 0 prints.

Figure 9:
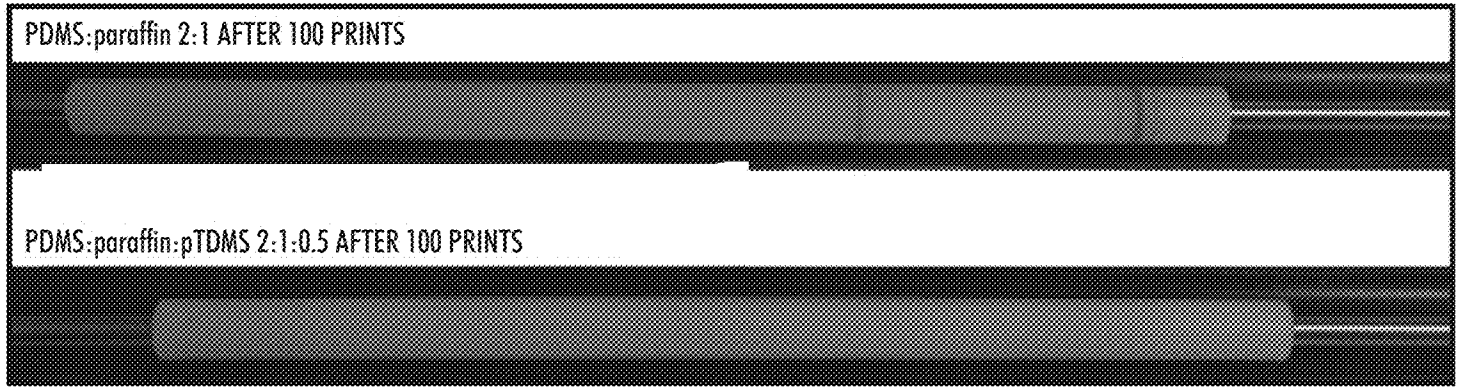

FIG. 9 shows photos of delivery rollers comprising by weight PDMS:paraffin oil 2:1; and PDMS:paraffin oil:pT-DMS 2:1:0.5 after aging about 5 days and 100 prints.

Figure 10:
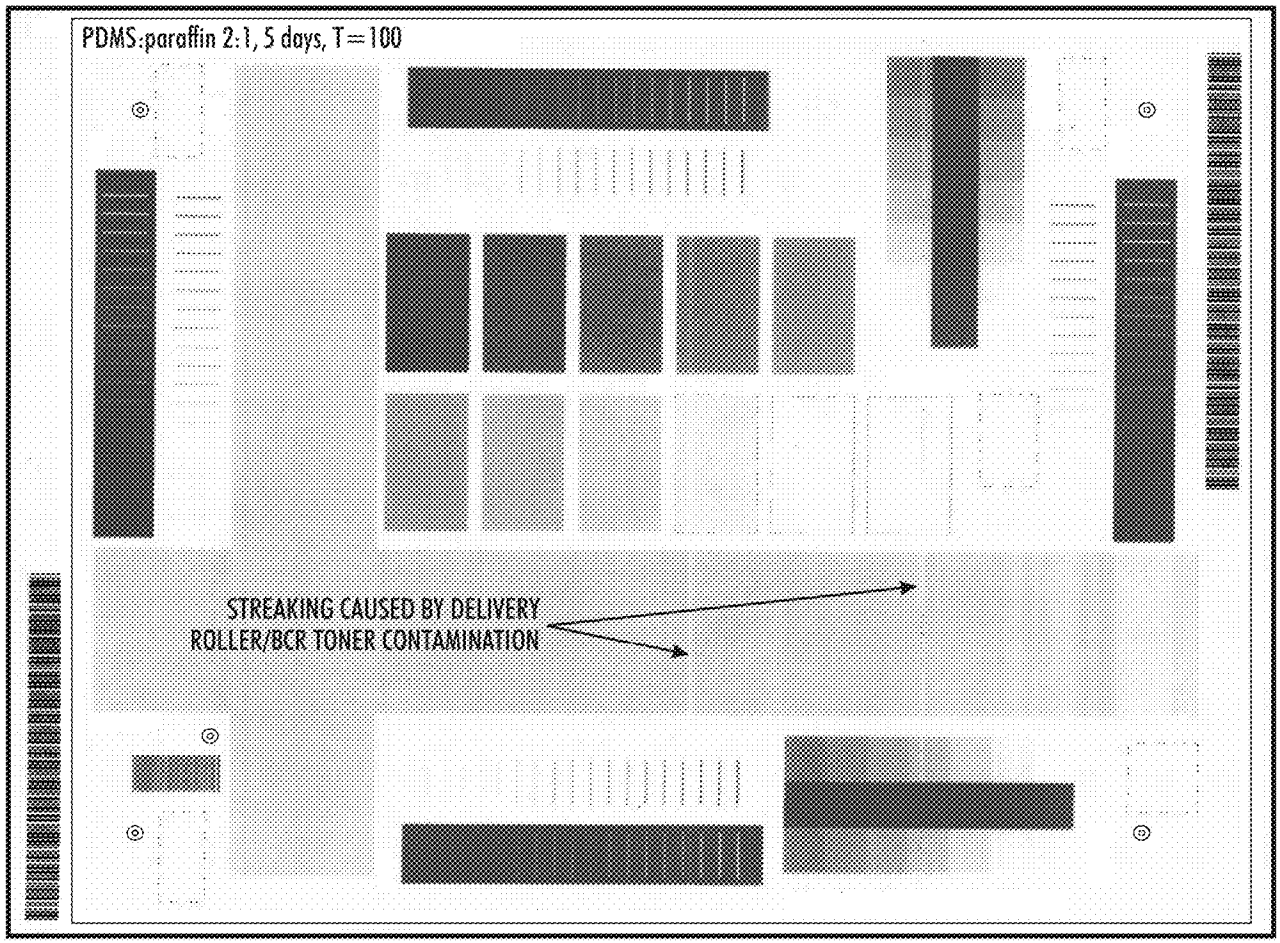

FIG. 10 depicts a print test performed with an image forming apparatus having a delivery roller comprising PDMS:paraffin oil 2:1 by weight after aging about 5 days and 100 prints.

It should be noted that some details of the figures have been simplified and are drawn to facilitate understanding of the embodiments rather than to maintain strict structural accuracy, detail, and scale.

DETAILED DESCRIPTION

A delivery member of embodiments can be integrated into an image forming apparatus in various configurations and positions. As an imaging member in an image forming apparatus moves, the delivery member can deliver a functional material directly to the surface of the imaging member or to the surface of a charging unit (which in turn delivers the functional material to the imaging member). Certain embodiments can be better understood with reference to the Drawings.

Figure 1A:
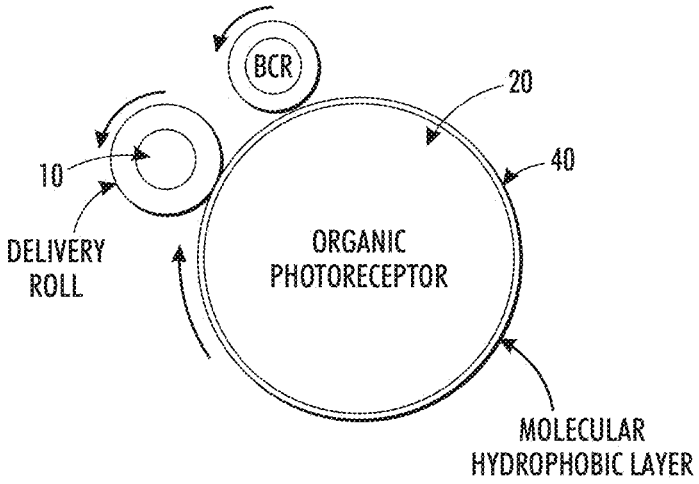
FIG. 1 illustrates two configurations of a delivery member (e.g., a delivery roller) in an image forming apparatus. The delivery member can be configured to apply a thin film of a functional material: a) directly to the surface of an imaging member; or b) to a charging unit which then transfers the material to the surface of the imaging member.

FIG. 1A illustrates one configuration of elements in an image forming apparatus. A delivery member 10 (e.g., delivery roll), an imaging member 20 (e.g., photoreceptor) and a charging unit 30 (e.g., bias charge roll (BCR)) are shown. The delivery member 10 contacts the imaging member 20 (e.g., photoreceptor) to deliver a layer 40 (e.g., an ultrathin layer of from about 1 nm to 200 nm, from about 5 nm to about 50 nm, or from about 8 nm to about 20 nm.) of a functional material (e.g., paraffin oil, among others known in the art) onto the surface of the imaging member 20. The imaging member 20 can be charged by the charging unit 30 (e.g., BCR) to initiate an electrophotographic reproduction process. The imaging member can be exposed to alter its surface charge thereby creating an electrostatic latent image on the imaging member. This latent image can subsequently be developed into a visible image by a toner developer. Thereafter, the developed image can be transferred from the imaging member to a copy sheet or some other image support substrate to which the image may be permanently affixed. The imaging member surface can be cleaned with a cleaner (e.g., a cleaning blade) to remove any residual developer or other contaminant in preparation for successive imaging cycles.

Figure 1B:
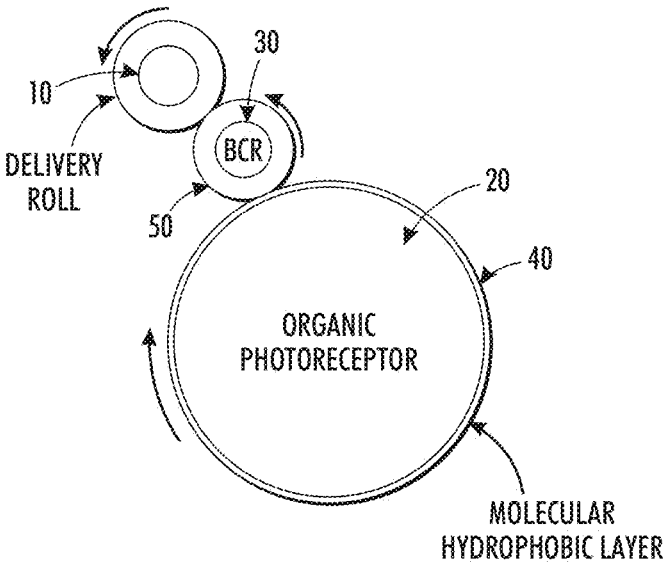

In an alternative configuration shown in FIG. 1*b*, the delivery member 10 contacts the charging unit 30 (e.g., BCR) to deliver a thin layer 50 of the functional material onto the surface of the charging unit. The charging unit 30, in turn, transfers the functional material onto the surface of the imaging member 20 (e.g., photoreceptor) as a thin layer 40 (e.g., molecular hydrophobic layer).

A delivery member according to embodiments can be used in an imaging forming apparatus or a subsystem of such an apparatus. In embodiments, the delivery member can be a component of a customer replaceable unit (CRU) of a xerographic printing system and deliver a functional material to the outer layer, for example, a protective overcoat layer, of an imaging member/photoreceptor. The imaging member can have a composition/structure known in the art.

An imaging member/photoreceptor can comprise at least a substrate layer, an imaging layer disposed on the substrate and an optional overcoat layer disposed on the imaging layer. The imaging layer can comprise a charge generation layer disposed on the substrate and a charge transport layer disposed on the charge generation layer. In other embodiments, an undercoat layer can be included and can be located between the substrate and the imaging layer, although additional layers can be present and located between these layers. The imaging member can also optionally include an anti-curl back coating layer. The imaging member can comprise a support substrate, an electrically conductive ground plane, an undercoat layer, a charge generation layer and a charge transport layer, in certain embodiments. An optional protective overcoat layer can be disposed on the charge transport layer. The charge generation layer and the charge transport layer can form an imaging layer as two separate layers. In an alternative configuration, the functional components of these two layers can be combined in a single layer.

In some embodiments, the imaging member can have a drum, cylinder, plate, belt or drelt configuration, among others known in the art. In a belt configuration, the imaging member can comprise an anti-curl back coating, a supporting substrate, an electrically conductive ground plane, an undercoat layer, an adhesive layer, a charge generation layer, and a charge transport layer, in some embodiments. An overcoat layer and ground strip can be included in an imaging member, in certain embodiments.

An overcoat layer can be disposed over the charge transport layer to provide imaging member surface protection as well as improve resistance to abrasion. The overcoat layer can be any known in the art for use with imaging members. The overcoat layer can have a thickness ranging from about 0.1 micrometers to about 25 micrometers or from about 1 micrometer to about 10 micrometers, or in a specific embodiment, about 3 micrometers to about 10 micrometers. The overcoat layer can comprise a charge transport component and an optional organic polymer or inorganic polymer, in some embodiments. Certain overcoat layers can comprise thermoplastic organic polymers or cross-linked polymers, such as thermosetting resins, UV or e-beam cured resins, and the like. In some embodiments, the overcoat layer can include a particulate additive, such as metal oxides including aluminum oxide and silica, or low surface energy polytetrafluoroethylene (PTFE), or a combination thereof.

Certain embodiments can result in significant run-cost reductions due to their increasing the life of imaging members. As discussed above, it is known in the art that robust overcoats can extend the life of imaging members, but incorporation of such overcoats into commercially successful devices has been hindered due to increased lateral charge migration (LCM) and friction between the cleaning blade and the surface of such overcoats. The performance of overcoated imaging members can be improved by applying a thin film (from about 1 nm to 200 nm, from about 5 nm to about 50 nm, or from about 8 nm to about 20 nm) of a functional material/lubricant (e.g., paraffin oil) using an extrinsic delivery system to address both the LCM and friction/torque problems. The thin film can act to lubricate a cleaning blade.

Figure 2:
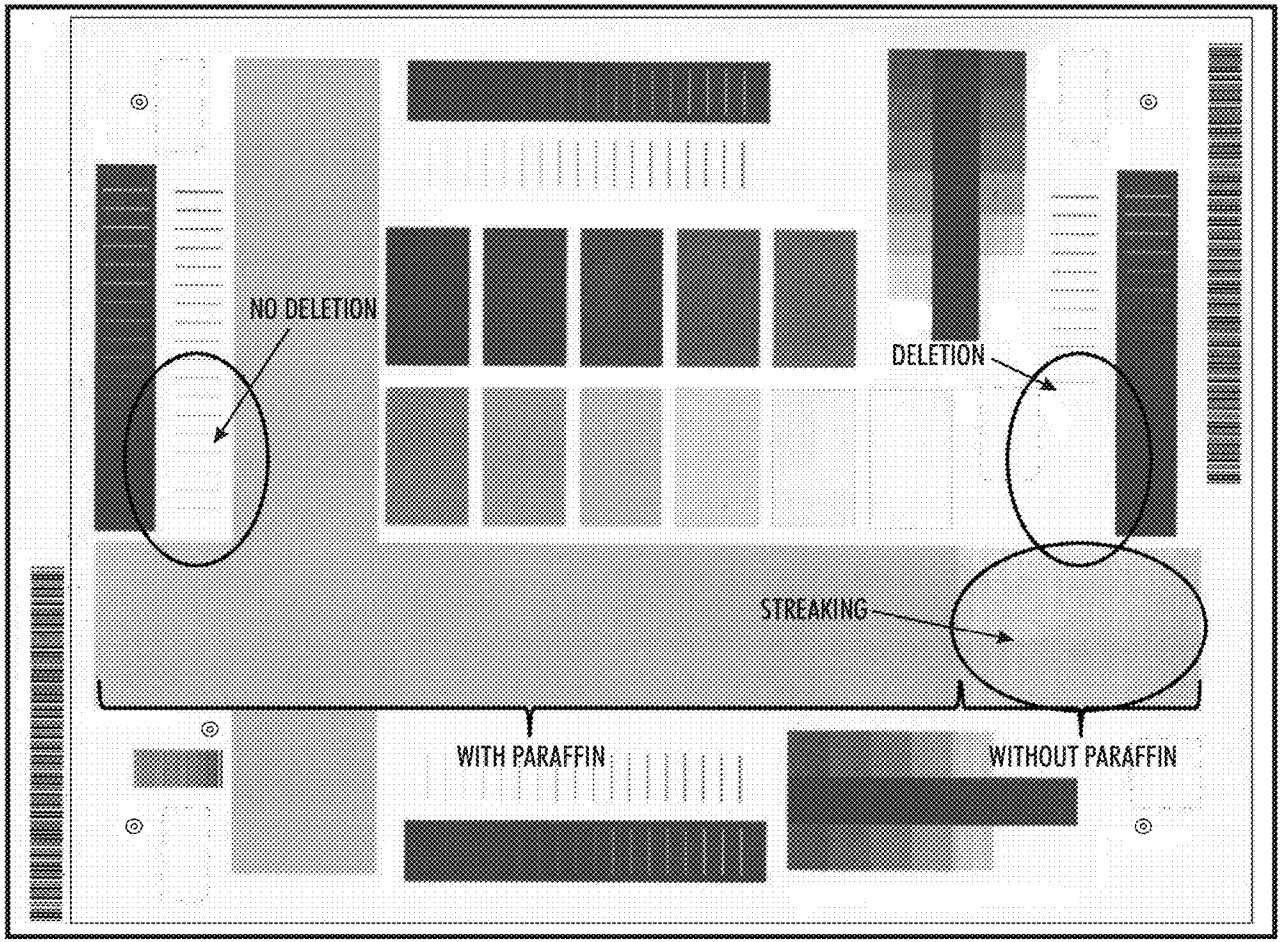
FIG. 2 depicts a print test performed using an image forming apparatus with a delivery member comprising a polydimethylsiloxane (PDMS) matrix/paraffin oil delivery roller disposed for application of paraffin oil on two-thirds of the length of a photoreceptor in the image forming apparatus after 32,500 prints.

A delivery member can be used to apply a layer of paraffin oil and/or other functional material to the surface of a photoreceptor/imaging member either directly (FIG. 1*a*) or via a charging unit (e.g., bias charge roll (BCR)) (FIG. 1*b*). The paraffin oil or other functional material can act both as a lubricant that reduces torque, and as a sacrificial layer that protects the overcoat of a photoreceptor/imaging member from damage caused by charging (by, for example, a BCR). BCR charging generates hydrophilic species in an organic film/overcoat, which can result in lateral charge migration (e.g., A-Zone deletion). FIG. 2 shows a print where a delivery roller with an outer layer of polydimethylsiloxane (PDMS) matrix mixed with paraffin oil was in contact with two-thirds of the length of a photoreceptor. The side that was in contact with the delivery roller shows no deletion, whereas the side without the roller (e.g., without applied paraffin oil) shows deletion and streaking.

Delivery members according to present embodiments can contain sufficient quantities of the functional material to continuously supply a thin or ultra-thin layer of less than about 10 nm of the functional material to the surface of the charging unit/imaging member in an image forming apparatus. The functional material can diffuse from the first layer to the surface of the delivery member, where it is transferred, directly or indirectly (via the charging unit), to an imaging member in an image forming apparatus.

A delivery member can be fabricated having a cross-linked elastomeric matrix in which a functional material is dispersed. The cross-linked elastomeric and the functional material can be incompatible materials, which can contribute to a high rate of diffusion of the functional material from the cross-linked elastomeric matrix. For example, PDMS (elastomeric matrix) and paraffin oil (functional material) are incompatible materials (i.e., silicone oil and paraffin oil are immiscible materials), and the incompatibility can cause the paraffin oil to passively diffuse out of a PDMS matrix even without the delivery member being in contact with another component, such as a BCR.

Passive diffusion of functional material (e.g., paraffin oil) out of a delivery member can cause functional material (i.e., paraffin oil) to pool against a charging unit or an imaging member when an image forming apparatus sits idle. Excessive amounts of functional material can cause image defects and can contribute to toner contamination. The passive diffusion can be greater at higher functional material:cross-linked elastomeric matrix (e.g., paraffin oil:PDMS matrix) ratios by weight, but passive diffusion can be minimized by lowering the amount of functional material stored in the cross-linked elastomeric matrix. To reduce contamination, while maintaining the necessary reservoir of functional material it would be desirable to better control passive leaking of functional material from a delivery member. Certain embodiments can control passive leaking by employing a first layer in a delivery member comprising a stabilizing polymer that can stabilize the functional material dispersed within the cross-linked elastomeric matrix that is a component of a delivery member.

Certain embodiments are drawn to delivery members comprising a support member and a first layer comprising a cross-linked elastomeric matrix, a stabilizing polymer comprising a polysiloxane backbone, and a functional material. The first layer is disposed on the support member. The functional material can diffuse to the surface of the delivery member in embodiments. In embodiments, the functional material can be dispersed in the cross-linked elastomeric matrix. The amount of the functional material delivered onto the surface of an imaging member or a charging unit is controlled (at least in part) by the diffusion rate of the functional material in the first layer.

In some embodiments the support member of the delivery member can comprise metal, plastic, ceramic, or a mixture of two or more thereof. In certain embodiments the support member of the delivery member can be a stainless steel rod. The diameter of the support member can be varied depending on the application needs. In some embodiments, the support member can have a diameter of between about 3 mm and about 10 mm.

The delivery member comprises a first layer comprising a cross-linked elastomeric matrix disposed around the support member. The cross-linked elastomeric matrix can comprise at least one cross-linked polymer. In certain embodiments, the polymer that is cross-linked can be selected from the group consisting of silicones, fluorosilicones, polyurethanes, polyesters, polyfluorosiloxanes, fluoroelastomers, synthetic rubbers, natural rubbers, and mixtures of two or more thereof. The cross-linked elastomeric matrix can comprise cross-linked polydimethylsiloxane (PDMS), in some embodiments.

As discussed above, in embodiments the first layer comprises a functional material dispersed within a cross-linked elastomeric matrix. The functional material can provide improved maintenance of desired photoreceptor function. It can provide lubrication and surface protection to a photoreceptor/imaging member. The thin layer of functional material on the imaging member can be provided on a nano-scale or molecular-level, and can act as a barrier against moisture and surface contaminants and improve xerographic performance in high humidity conditions, such as for example A-zone environments (e.g., 28° C., 85% relative humidity).

Not to be bound by theory, A-zone deletion can be caused by a number of occurrences, including, high energy charging which results in the formation of hydrophilic chemical species (e.g., —OH, —COOH) on the imaging member surface, water being physically absorbed on the imaging member surface in a humid environment, and an increase in the surface conductivity of the imaging member due to the absorbed water layer and toner contaminants. In embodiments, there can be controlled delivery of a thin layer of a functional material, such as a hydrophobic material, to the surface of an imaging member (e.g., low-wear overcoated photoreceptor) to reduce or prevent A-zone deletion.

Integration of a functional material into the composition of the delivery member can eliminate the need for a separate supply of materials within the system or the need to constantly reapply the material to the delivery member in embodiments. Thus, the delivery member can act as both a reservoir and distributor for the functional material. The delivery members can contain sufficient quantities of a functional material to continuously supply a thin or ultra-thin layer of functional material to the surface of a charging unit/imaging member to extend the life of the imaging member.

In embodiments, the functional material can be an organic or inorganic compound, a monomer or a polymer, or a mixture thereof. The functional material can comprise a lubricant material, a hydrophobic material, an oleophobic material, an amphiphilic material, or a mixture of two or more thereof. The functional material can be in the form of a liquid, a wax, a gel, or a mixture of two or more thereof. In certain embodiments, the functional material can comprise a material selected from the group consisting of alkanes, fluoroalkanes, silicone oils, mineral oil, synthetic oils, natural oils, and mixtures of two or more thereof. The functional material can include a hydrophobic compound or hydrophobic polymer, in some embodiments. In certain embodiments, the functional material can comprise a paraffin oil. In some embodiments, the functional material can comprise a paraffin oil having a specific viscosity between about 50 mPa·s and about 230 mPa·s, between about 80 mPa·s and about 180 mPa·s, or between about 100 mPa·s and about 145 mPa·s.

In some embodiments, the stabilizing polymer can comprise a polysiloxane backbone and a repeating unit having formula I

I

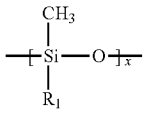

wherein $R_1$ of each repeating unit is selected from the group consisting of substituted and unsubstituted alkyl groups, branched alkyl groups, alkylaryl groups, and arylalkyl groups; $R_1$ of each repeating unit comprises from about 3 carbon atoms to about 30 carbon atoms, about 14 carbon atoms to about 18 carbon atoms, or about 16 carbon atoms to about 18 carbon atoms; $R_1$ is the same or different for all repeating units having formula I in the stabilizing polymer; and x is between about 5 and about 5000 repeating units, about 5 and about 1000 repeating units; or about 5 and about 500 repeating units. In certain embodiments, $R_1$ is an alkyl group. $R_1$ can be a C14 to C18 group; a C14 to C16 group; or a C16 to C18 group, in some embodiments.

In certain embodiments, the stabilizing polymer can comprise a polysiloxane having formula II

II

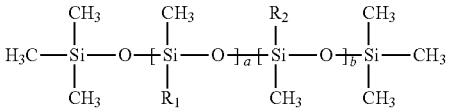

wherein $R_1$ is selected from the group consisting of substituted and unsubstituted alkyl groups, branched alkyl groups, alkylaryl groups, and arylalkyl groups; $R_1$ comprises from about 3 carbon atoms to about 30 carbon atoms, about 14 carbon atoms to about 18 carbon atoms, or about 16 carbon atoms to about 18 carbon atoms; and $R_1$ is the same or different for all repeating units containing $R_1$; wherein $R_2$ is a hydrogen or a methyl; and wherein a is from about 0.1 to about 0.95, about 0.3 to about 0.9, or about 0.5 to about 0.8, b is from about 0.05 to about 0.9, about 0.1 to about 0.7, or about 0.2 to about 0.5 and a+b=1 in the mole ratio a:b of repeating units within the polysiloxane having formula II. In certain embodiments, $R_1$ is an alkyl group. $R_1$ can be a C14 to C18 group; a C14 to C16 group; or a C16 to C18 group, in some embodiments.

The stabilizing polymer can have a molecular weight (Mw) of between about 100 and about 500,000; between about 100 and about 100,000; or between about 500 and about 50,000. In some embodiments, the stabilizing polymer can be selected from the group consisting of methylhydrosiloxane-octylmethyl siloxane (MHOMS) copolymer, polytetradecylmethylsiloxane (pTDMS), and mixtures thereof. In certain embodiments, the stabilizing polymer can be a poly(dimethylsiloxane-co-alkylmethylsiloxane) wherein the alkyl group can be a C14 to C18 group or a C16 to C18 group.

Stabilizing polymers, such as methylhydrosiloxane-octylmethyl siloxane (MHOMS) copolymer and polytetradecylmethylsiloxane (pTDMS), have both siloxane and alkane type structures. In embodiments, such polymers with both types of structures can be used as stabilizing polymers to stabilize a functional material (e.g., paraffin oil) in a cross-linked elastomeric matrix (e.g., PDMS matrix) of a delivery member, which can permit a higher loading of functional material within the delivery member, while reducing or preventing passive leaking.

A delivery member of some embodiments can have a cross-linked elastomeric matrix comprising cross-linked polydimethylsiloxane (PDMS), a functional material comprising a paraffin oil, and a stabilizing polymer comprising a repeating unit having formula I or formula II, as described above.

In certain embodiments, the first layer comprises between about 1 wt % and about 80 wt %; about 5 wt % and about 50 wt %; or about 10 wt % and about 20 wt % of the stabilizing polymer relative to the total weight of the first layer. The first layer can comprise between about 20 wt % and about 80 wt %; about 30 wt % and about 70 wt %; or about 50 wt % and about 60 wt % of the cross-linked elastomeric matrix relative to the total weight of the first layer. In some embodiments, the first layer can have a thickness of between about 20 μm and about 100 mm; about 100 μm and about 30 mm; or between about 0.5 mm and about 10 mm. In some embodiments, the first layer comprises pores having a diameter of between about 10 nm and about 50 μm; about 20 nm and about 10 μm; or about 50 nm and about 5 μm. In embodiments, the weight ratio of functional material to cross-linked elastomeric matrix can be between about 1:10 and about 1:1; about 1:8 and about 11:20; or about 9:20 and about 11:20, or expressed differently between about 10% (1:10) and about 50% (1:1); about 12% and about 45% or about 45% and about 55%

The delivery member can be in the form of a delivery roller, a film, a belt, a web, or a blade applicator, in some embodiments. In certain embodiments, the delivery member can be a delivery roller. In some embodiments, the first layer can have a patterned outside surface or a smooth surface. The delivery member can have a surface pattern comprising indentations or protrusions that have a three-dimensional shape. The surface pattern can comprise protrusions having a sphere shape, a hemisphere shape, a rod shape, a polygon shape, or two or more of such shapes.

In certain embodiments the delivery member can further comprise a second layer disposed over the first layer, wherein the functional material can diffuse therethrough. The second layer can have a thickness of between about 0.1 μm and about 1 mm; about 0.2 μm and about 0.9 mm; or about 0.3 μm and about 0.07 mm. The second layer can comprise a material selected from the group consisting of polysiloxanes, polyurethanes, polyesters, polyfluorosiloxanes, polyolefins, fluoroelastomers, synthetic rubbers, natural rubbers, and mixtures of two or more thereof.

Some embodiments are drawn to methods of producing a delivery member for use in an image forming apparatus, the method comprising: applying to the outer surface of a support member a coating mixture (e.g., comprising an elastomer capable of being cross-linked, a stabilizing polymer comprising a polysiloxane backbone, and a functional material), and curing the coating mixture thereby forming a first layer. In certain embodiments, a functional material and a stabilizing polymer can be mixed with an elastomer capable of being cross-linked; cast around a support member (in a mold, for example); and cured to form a first layer over the support member, such that the stabilizing polymer and/or the functional material is dispersed in the resulting cross-linked elastomeric matrix. After curing, the first layer of the coated support member can be further impregnated by immersion in a functional material (e.g., paraffin oil) in preparing a delivery member, in certain embodiments.

Figure 3:
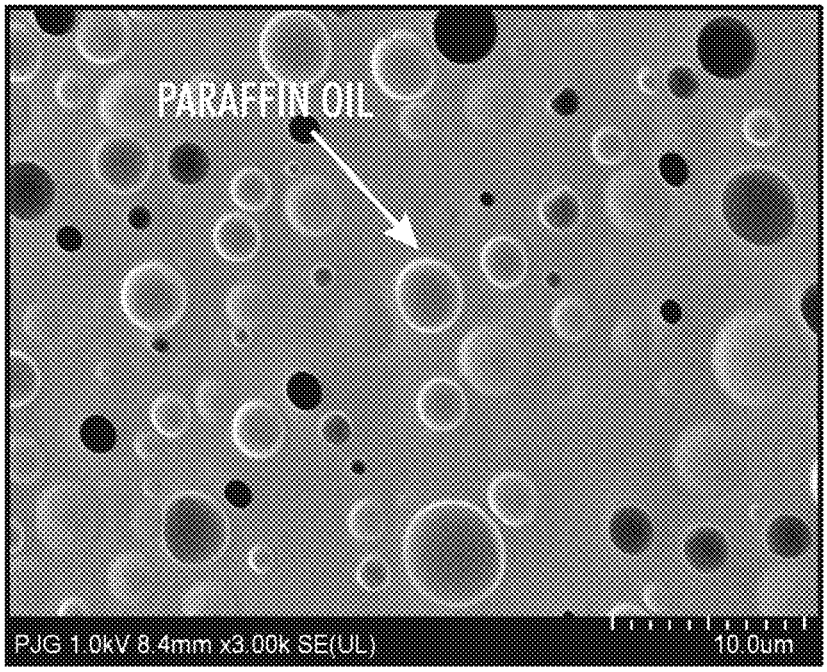
FIG. 3 is a scanning electron microscopy (SEM) image showing paraffin oil-filled pores dispersed in a solid PDMS matrix.

Delivery members can be fabricated by (a) mixing an elastomer capable of being cross-linked (such as, polydimethylsiloxane (PDMS)) with a functional material (such as, paraffin oil) and a stabilizing polymer (b) injecting the mixture into a mold (containing a support member), and (c) curing the elastomer to produce a cross-linked elastomeric matrix (such as a PDMS matrix). The functional material (i.e., paraffin oil) can thereby be dispersed in the matrix (FIG. 3 showing paraffin oil dispersed in a PDMS matrix).

Certain embodiments are drawn to coating mixtures for a delivery member comprising an elastomer capable of being cross-linked, a stabilizing polymer comprising a polysiloxane backbone, and a functional material. The elastomer capable of being cross-linked can be selected from the group consisting of silicones, fluorosilicones, polyurethanes, polyesters, polyfluorosiloxanes, fluoroelastomers, synthetic rubbers, natural rubbers, and mixtures of two or more thereof. In some embodiments, the elastomer capable of being cross-linked can be polydimethylsiloxane. In certain coating mixtures, the stabilizing polymer comprising a polysiloxane backbone can be as described above. In some coating mixtures, the stabilizing polymer can be selected from the group consisting of methylhydrosiloxane-octylmethyl siloxane (MHOMS) copolymer, polytetradecylmethylsiloxane (pTDMS), and mixtures thereof. The functional material in the coating mixtures can be as described above. Such coating mixtures can be suitable for use in methods of producing a delivery member, described above.

In embodiments, the addition of stabilizing polymers that have both siloxane characteristics and alkane characteristics into a coating mixture for a delivery member can help to stabilize the functional material (e.g., paraffin oil) in a cross-linked elastomeric matrix (e.g., PDMS matrix), thereby stopping or reducing passive leaking.

Some embodiments are drawn to image forming apparatuses comprising: an imaging member having a charge retentive surface, a charging unit for applying an electrostatic charge on the imaging member; and a delivery member disposed in contact with a surface of the imaging member (e.g., surface of overcoat of a photoreceptor) or a surface of the charging unit. The delivery member comprises a support member, and a first layer comprising a cross-linked elastomeric matrix, a stabilizing polymer comprising a polysiloxane backbone, and a functional material, wherein the first layer is disposed on the support member. An image formed using image forming apparatuses of embodiments can have little or no background darkening or streaking visible to the naked eye. In some embodiments, A-zone lateral charge migration (LCM) is reduced or prevented when forming an image with the image forming apparatus. In some embodiments, when a layer of functional material (such as a layer of paraffin oil) has been applied to an imaging member in an image forming apparatus, the resulting OD (measured optical density) can be between about 0.05 and 0.065 for the background of an image formed by the apparatus, and in an image forming apparatus having the same imaging member, but without a layer of the functional material, the OD can be about 0.046 or less.

The image forming apparatus of certain embodiments can have a functional material present on the surface of the imaging member in an amount of between about 0.5 nanograms/cm$^2$ and about 500 nanograms/cm$^2$. In certain embodiments, the image forming apparatus can comprise a delivery member having a first layer comprising between about 1 wt % and about 80 wt % of the stabilizing polymer relative to the total weight of the first layer. In some embodiments, the image forming apparatus can comprise a delivery member having a weight ratio of functional material to cross-linked elastomeric matrix that is between about 1:10 and 3:5. In some embodiments, an image forming apparatus can comprise a charging unit comprising a biased charging roller (BCR) in direct contact with an imaging member, and a delivery member can be disposed in direct contact with a surface of the BCR, such that the delivery member applies the functional material onto the surface of the BCR, which in turn delivers the functional material onto the surface of the imaging member.

In some embodiments the image forming apparatus can comprise a delivery member having a cross-linked elastomeric matrix comprising cross-linked polydimethylsiloxane (PDMS), a functional material comprising a paraffin oil, and a stabilizing polymer comprising a repeating unit having formula I or formula II, as described above.

As discussed above, it is known in the art that robust overcoats can increase lateral charge migration (LCM), among other potential problems. The performance of overcoated imaging members can be improved by applying a thin film of a functional material/lubricant using a delivery member to address the LCM issue. As detailed above, A-zone deletion may be caused by high energy charging resulting in the formation of hydrophilic chemical species (e.g., —OH, —COOH) on the imaging member surface, water being physically absorbed on the imaging member surface in an humid/A-zone environment (e.g., 28° C., 85% relative humidity), and an increase in the surface conductivity of the imaging member due to the absorbed water layer and toner contaminants. A thin layer of functional material on the imaging member can be provided on a nano-scale or molecular-level and act as a barrier against moisture and surface contaminants and improve xerographic performance in high humidity conditions, such as for example A-zone environments. In embodiments, there can be controlled delivery of a thin layer of a functional material, such as a hydrophobic material, to the surface of an imaging member (e.g., low-wear overcoated photoreceptor) in an image forming apparatus to reduce or prevent A-zone deletion.

In some embodiments, the functional material can be present on the surface of an imaging member in an amount of between about 8 nanograms/cm$^2$ and about 1000 nanograms/cm$^2$; about 20 nanograms/cm$^2$ and about 160 nanograms/cm$^2$; or about 50 nanograms/cm$^2$ and about 120 nanograms/cm$^2$. The thin layer of functional material on the surface of an imaging member can have a thickness between about 1 nm and about 60 nm, about 3 nm and about 20 nm, or about 8 nm and about 10 nm. In certain embodiments, the functional material can be present on the surface of a charging unit in an amount of between about 8 nanograms/cm$^2$ and about 1000 nanograms/cm$^2$; or about 20 nanograms/cm$^2$ and about 160 nanograms/cm$^2$; or about 50 nanograms/cm$^2$ and about 120 nanograms/cm$^2$. The functional material can be delivered to the charging unit or imaging member at a rate of between about 0.1 mg/Kcycle and about 20 mg/Kcycle; about 1 mg/Kcycle and about 10 mg/Kcycle; or about 3 mg/Kcycle and about 8 mg/Kcycle.

Certain embodiments are drawn to methods of reducing printing defects by an image forming apparatus comprising: (a) providing a delivery member in the image forming apparatus, wherein the delivery member comprises a support member, and a first layer comprising a cross-linked elastomeric matrix, a stabilizing polymer comprising a polysiloxane backbone, and a functional material, disposed on the support member, and wherein the image forming apparatus further comprises an imaging member having a charge retentive surface, and a charging unit for applying an electrostatic charge on the imaging member; and (b) contacting the delivery member with a surface of the imaging member (e.g., surface of imaging member's overcoat) or a surface of the charging unit to apply a layer of the functional material to the surface of the imaging member or the surface of the charging unit. The delivery member, including the cross-linked elastomeric matrix, the stabilizing polymer comprising a polysiloxane backbone, and the functional material, can be as described above. The imaging member and charging unit can be any known in the art. The imaging member can comprise a protective overcoat in some embodiments.

Embodiments disclosed herein can permit maximization of the amount of functional material (e.g., paraffin oil) stored in a delivery member in order to increase its useful life and/or the life of an imaging member. To achieve this, it is desirable that passive diffusion of a functional material (such as, paraffin oil) during parking/idling of an image forming apparatus be eliminated or reduced, as in some embodiments. Not to be bound by theory, an incorporated stabilizing polymer can interact both with the cross-linked elastomeric matrix (e.g., PDMS matrix) and the functional material (e.g., paraffin oil) of a delivery member, which can mitigate incompatibility between the functional material and the cross-linked elastomeric matrix. In embodiments, the inclusion of stabilizing polymers in delivery members can control passive leaking of functional material (e.g., paraffin oil) from a delivery member, which can reduce or prevent wasteful consumption of the functional material and reduce or prevent contamination of components caused by delivery of excess functional material, thereby improving the quality of images formed.

The following Examples further define and describe embodiments herein. Unless otherwise indicated, all parts and percentages are by weight.

EXAMPLES

Example 1—Preparation of Formulations with Stabilizing Polymer

Figure 4:
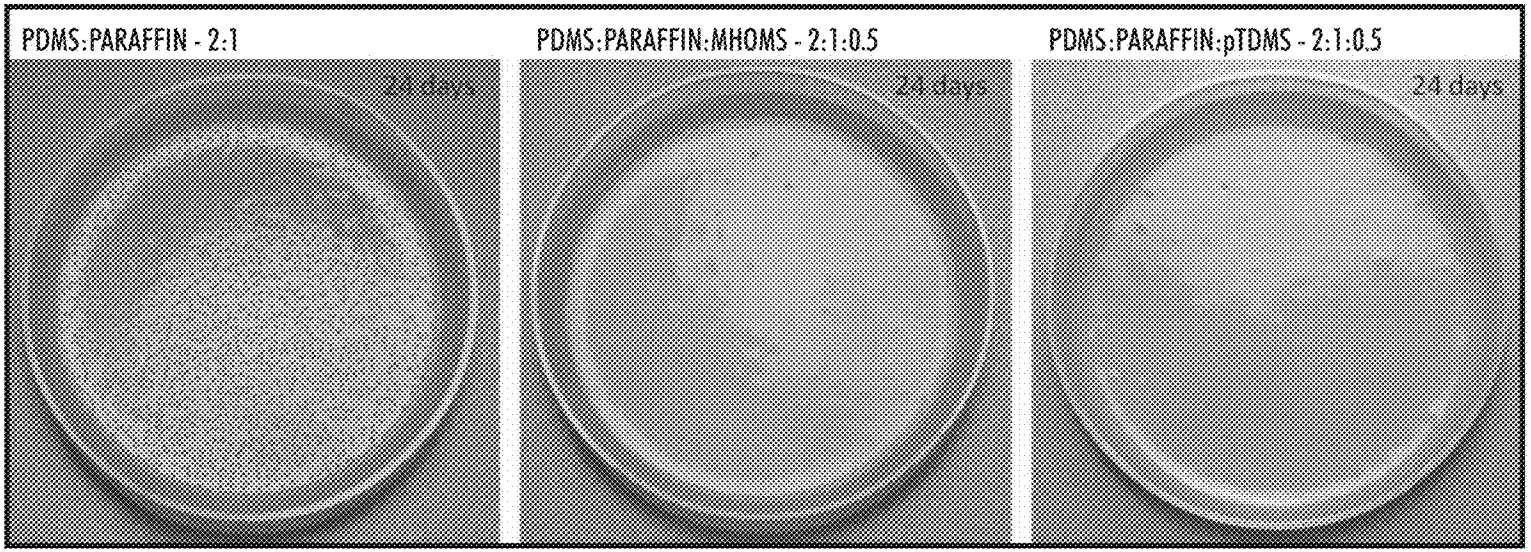
FIG. 4 shows photos of samples of PDMS:paraffin oil 2:1, PDMS:paraffin oil:MHOMS (methylhydrosiloxane-octylmethyl siloxane copolymer) 2:1:0.5, and PDMS:paraffin oil:pTDMS (polytetradecylmethylsiloxane) 2:1:0.5 in polystyrene petri dishes about 24 days after they were prepared. (Ratios were by weight.)

Three formulations of polydimethylsiloxane (PDMS) (Dow Chemical Co.) and paraffin oil, with and without a stabilizing polymer (Gelest) were prepared and then cured in polystyrene petri dishes. The three formulations were as follows: a) PDMS:paraffin oil 2:1 (FIG. 4*a*); b) PDMS: paraffin oil:MHOMS (methylhydrosiloxane-octylmethyl siloxane) 2:1:0.5 (FIG. 4*b*); and c) PDMS:paraffin oil: pTDMS (polytetradecylmethylsiloxane) 2:1:0.5 (FIG. 4*c*). The ratios were by weight.

Figure 5:
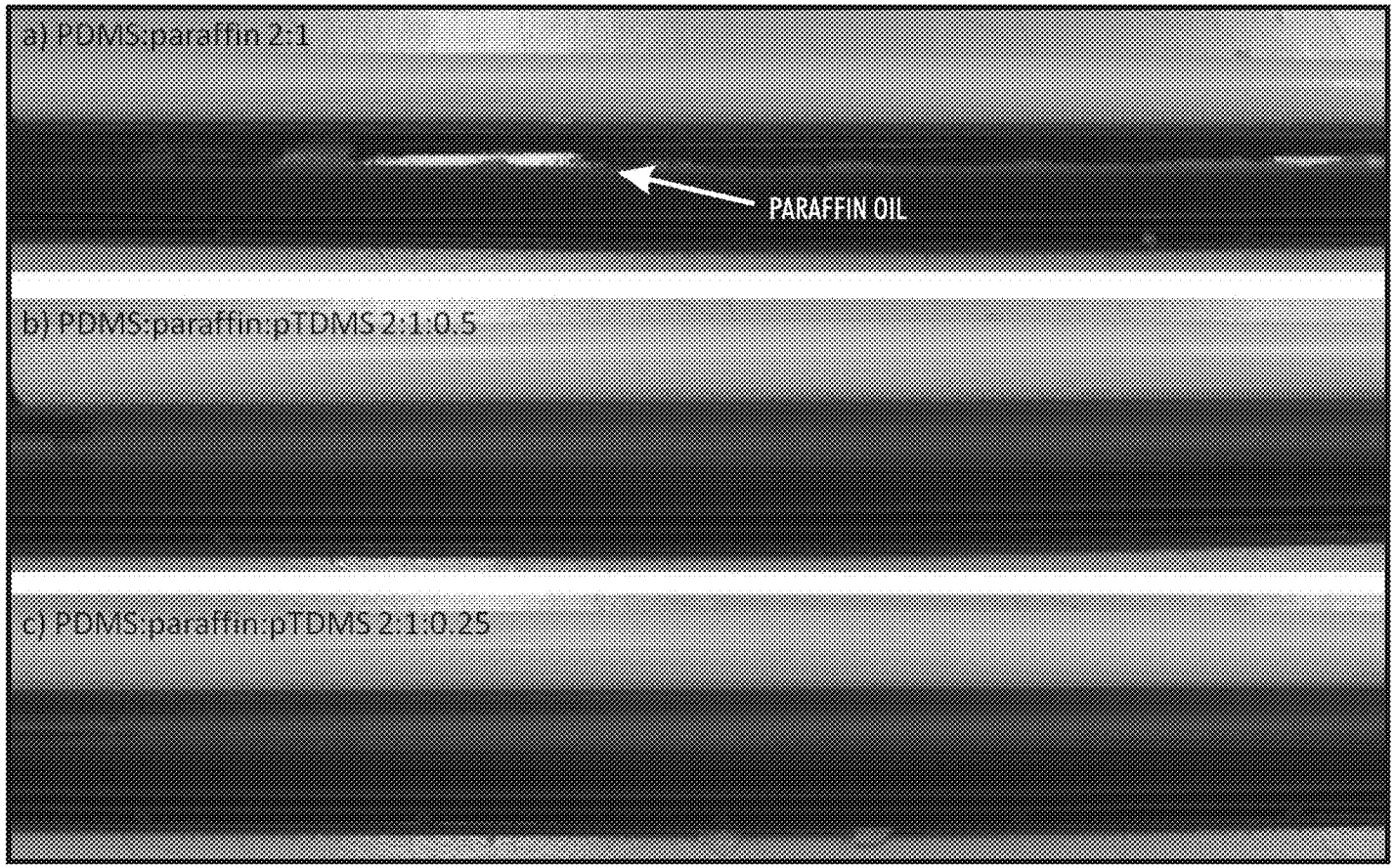
FIG. 5 shows photos of delivery rollers prepared with formulations by weight: a) PDMS:paraffin oil 2:1, b) PDMS.

Paraffin oil started to diffuse from the PDMS in the PDMS:paraffin oil 2:1 formulation by weight (FIG. 4*a*) within 48 hours of curing. In contrast, paraffin oil did not diffuse from the PDMS in the formulations where stabilizing polymers (e.g., MHOMS and pTDMS) were used (FIGS. 4*b* and 4*c*). FIG. 5 shows the three formulations about 24 days after they were cured. The PDMS:paraffin oil 2:1 sample without the stabilizing polymer had paraffin oil droplets on its surface indicative of passive leaking over time, whereas the other two samples that contained stabilizing polymers (e.g., MHOMS and pTDMS) did not have paraffin oil droplets at the surface, indicating that passive leaking of paraffin oil was suppressed.

Example 2—Preparation of Delivery Rollers with Stabilizing Polymer

Three delivery rollers were prepared with formulations of PDMS, paraffin oil, and stabilizing polymer, as in Example 1. The three formulations by weight used in making the surface layers for the delivery rollers were as follows: a PDMS:paraffin oil 2:1 (FIGS. 5*a* and 6*a*); bi) PDMS:paraffin oil:pTDMS 2:1:0.5 (FIGS. 5*b* and 6*b*); and c) PDMS: paraffin oil:pTDMS 2:1:0.25 (FIGS. 5*c* and 6*c*). After curing, these delivery rollers were placed in contact with a BCR (bias charge roll) to evaluate the extent of passive diffusion onto the BCR after i) 24 hours (FIG. 5) and ii) after 5 days (FIG. 6).

After 24 hours, a significant amount of paraffin oil diffused from the PDMS matrix onto the BCR from the 2:1 PDMS:paraffin oil roller, whereas the rollers containing pTDMS as a stabilizing polymer did not diffuse paraffin oil. The amount of paraffin oil on the BCR from the 2:1 PDMS:paraffin oil roller was sufficient to cause image defects and exacerbate contamination on the BCR. After 5 days, a small amount of paraffin oil diffused onto the BCR from the delivery rollers with the stabilizing polymers, but this amount was not sufficient to cause detrimental image quality issues or contamination. For these delivery rollers to function properly, it was important that some paraffin oil still diffuse out of the roller onto the BCR.

Example 3—Preparation of Prints Using Delivery Rollers

Delivery Rollers with surface layers containing a) PDMS: paraffin oil (2:1), and b) PDMS:paraffin oil:pTDMS (2:1: 0.5) were integrated into Xerox DC250 CRU's (customer replaceable units) with overcoated photoreceptors. These surface layers containing paraffin oil only spanned two-thirds of the length of the imaging member/photoreceptor, so that there was a region to which paraffin oil was delivered to the charging unit/imaging member (e.g., BCR/photoreceptor) and a control region (about one-third of the photoreceptor) to which no paraffin oil was delivered.

After 24 hours, the CRU's were inserted into a Xerox machine DC250 and used to print 100 prints.

FIG. 7*a* shows the first printed image (T=0) from the PDMS:paraffin oil 2:1 roller. In the region with no paraffin oil, there was deletion of the fine bit lines, whereas the side with the paraffin oil had no such deletion. However, the side with the paraffin oil showed inefficient toner transfer (in the half-tone regions) due to the presence of excess paraffin oil where the roller was in contact with the BCR for 24 hours. FIG. 7*b* shows T=0 (time zero) for the CRU with a PDMS: paraffin oil:pTDMS 2:1:0.5 delivery roller; deletion was evident on the side without paraffin oil and no deletion or inefficient toner transfer was apparent on the side with the paraffin oil, indicating that paraffin oil was delivered in an amount sufficient to prevent A-zone deletion.

Over 5 days, paraffin oil leaked from the PDMS:paraffin oil 2:1 delivery roller, which exacerbated inefficient toner transfer when prints were made (FIG. 8*a*). The CRU with the PDMS:paraffin oil:pTDMS 2:1:0.5 delivery roller did not deliver excessive amounts of paraffin oil after 24 hours or after 5 days. FIG. 8*b* shows the T=0 (at time zero) IQAF (image quality analysis facility) image obtained from this roller after sitting in the CRU for 5 days before printing. There was no deletion on the side of the image with the delivery roller (e.g., with paraffin oil), whereas there was deletion on the side without. There was successful toner transfer because there was not an excessive amount of paraffin oil delivered as the roller did not passively leak paraffin oil over the 5 days it was sitting idle in the CRU.

Leaking of paraffin oil over time causes toner contamination of the BCR and the delivery roller. This type of contamination can lead to streaking in prints due to inefficient charging of the imaging member (e.g., photoreceptor) by the contaminated BCR. FIG. 9*a* shows toner contamination on the PDMS:paraffin oil 2:1 delivery roller after running 100 prints after the roller had been left idle in the CRU for 5 days; FIG. 9*b* shows no toner contamination on the PDMS:paraffin oil:pTDMS 2:1:0.5 delivery roller after running 100 prints using the roller that had been aged 5 days in the CRU. The lack of contamination indicated that excessive amounts of paraffin oil had not leaked from the roller in that idle time. FIG. 10*a* shows the T=100 print obtained from the CRU with the PDMS:paraffin oil 2:1 delivery roller. Streaks in the prints were caused by the contamination.

The Examples demonstrated that a stabilizing polymer (pTDMS or MHOMS) helped stabilize paraffin oil in a PDMS matrix, and the passive leaking of paraffin oil from the PDMS matrix delivery rollers was prevented or reduced. Delivery rollers containing the stabilizing polymers delivered sufficient paraffin oil to lubricate and prevent A-Zone deletion. There was less contamination on the BCR when a roller containing stabilizing polymer was used as compared to a roller without stabilizing polymer.

To the extent that the terms "containing," "including," "includes," "having," "has," "with," or variants thereof are used in either the detailed description and the claims, such terms are intended to be inclusive in a manner similar to the term "comprising."

Further, in the discussion and claims herein, the term "about" indicates that the values listed may be somewhat altered, as long as the alteration does not result in nonconformance of the process or structure to the illustrated embodiment.

Notwithstanding that the numerical ranges and parameters setting forth the broad scope of the present teachings are approximations, the numerical values set forth in the specific examples are reported as precisely as possible. Any numerical value, however, inherently contains certain errors necessarily resulting from the standard deviation found in their respective testing measurements. Moreover, all ranges disclosed herein are to be understood to encompass any and all sub-ranges subsumed therein. For example, a range of "less than 10" can include any and all sub-ranges between (and including) the minimum value of zero and the maximum value of 10, that is, any and all sub-ranges having a minimum value of equal to or greater than zero and a maximum value of equal to or less than 10, e.g., 1 to 5. In certain cases, the numerical values as stated for the parameter can take on negative values. In this case, the example value of range stated as "less than 10" can assume values as defined earlier plus negative values, e.g., −1, −1.2, −1.89, −2, −2.5, −3, −10, −20, and −30, etc.

It will be appreciated that variants of the above-disclosed and other features and functions, or alternatives thereof, may be combined into many other different systems or applications. Various presently unforeseen or unanticipated alternative, modifications, variations or improvements therein may be subsequently made by those skilled in the art which are also intended to be encompassed by the following claims.

What is claimed is:

1. A delivery member for use in an image forming apparatus comprising:

a support member, and a first layer comprising a cross-linked elastomeric matrix, a stabilizing polymer and a functional material, wherein a weight ratio of the cross-linked elastomeric matrix, the functional material and the stabilizing polymer is 2:1:0.5, wherein the cross-linked elastomeric matrix is polydimethylsiloxane, wherein said stabilizing polymer is selected from the group consisting of methylhydrosiloxane-octylmethyl siloxane (MHOMS) copolymer and polytetradecylmethylsiloxane (pTDMS), wherein the functional material is paraffin oil, wherein the first layer is disposed on the support member, wherein the stabilizing polymer and the functional material are dispersed in the cross-linked elastomeric matrix of the first layer, wherein passive diffusion of the functional material from the delivery member during parking/idling of an image-forming apparatus is eliminated for up to 24 days after formation of the first layer.

2. The delivery member of claim 1, wherein the stabilizing polymer is polytetradecylmethylsiloxane (pTDMS).

3. The delivery member of claim 1, wherein the stabilizing polymer is methylhydrosiloxane-octylmethyl siloxane (MHOMS) copolymer.

4. The delivery member of claim 1, wherein the delivery member is configured to apply a thin film of the functional material directly to a surface of an imaging member.

5. The delivery member of claim 1, wherein said delivery member is in contact with a bias charging roll.

6. The delivery member of claim 5, wherein the functional material does not passively diffuse from the delivery member onto the bias charging roll after 24 hours.

7. The delivery member of claim 5, wherein an amount of the functional material that passively diffuses from the delivery member onto the bias charging roll after five days is reduced in comparison to an amount of functional material that passively diffuses from a control delivery member onto a bias charging roll, wherein the control delivery member comprises a support member and a first layer comprising polydimethylsiloxane and paraffin in a 2:1 weight ratio in the absence of stabilizing polymer.

8. A delivery member for use in an image forming apparatus comprising:

a support member, and a first layer comprising a cross-linked elastomeric matrix, a stabilizing polymer and a functional material, wherein a weight ratio of the cross-linked elastomeric matrix, the functional material and the stabilizing polymer is 2:1:0.25, wherein the cross-linked elastomeric matrix is polydimethylsiloxane, wherein said stabilizing polymer is selected from the group consisting of methylhydrosiloxane-octylmethyl siloxane (MHOMS) copolymer and polytetradecylmethylsiloxane (pTDMS), wherein the functional material is paraffin oil, wherein the first layer is disposed on the support member, wherein the stabilizing polymer and the functional material are dispersed in the cross-linked elastomeric matrix of the first layer, wherein passive diffusion of the functional material from the delivery member during parking/idling of an image-forming apparatus is eliminated for up to 24 days after formation of the first layer.

9. The delivery member of claim 8, wherein said delivery member is in contact with a bias charging roll.

10. The delivery member of claim 9, wherein the functional material does not passively diffuse from the delivery member onto the bias charging roll after 24 hours.

11. The delivery member of claim 9, wherein an amount of the functional material that passively diffuses from the delivery member onto the bias charging roll after five days is reduced in comparison to an amount of functional material that passively diffuses from a control delivery member onto a bias charging roll, wherein the control delivery member comprises a support member and a first layer comprising polydimethylsiloxane and paraffin in a 2:1 weight ratio in the absence of stabilizing polymer.

12. The delivery member of claim 8, wherein the delivery member is configured to apply a thin film of the functional material directly to the surface of an imaging member.

13. A delivery member for use in an image forming apparatus comprising:

a support member, and a first layer comprising a cross-linked elastomeric matrix, a stabilizing polymer and a functional material, wherein a weight ratio of the cross-linked elastomeric matrix, the functional material and the stabilizing polymer is 2:1:0.5, wherein the cross-linked elastomeric matrix is polydimethylsiloxane, wherein said stabilizing polymer is selected from the group consisting of methylhydrosiloxane-octylmethyl siloxane (MHOMS) copolymer and polytetradecylmethylsiloxane (pTDMS), wherein the functional material is paraffin oil, wherein the first layer is disposed on the support member, wherein the stabilizing polymer and the functional material are dispersed in the cross-linked elastomeric matrix of the first layer, wherein the delivery member is configured to apply a thin film of the functional material to a charging unit which then transfers the material to a surface of an imaging member and wherein passive diffusion of the functional material from the delivery member during parking/idling of an image-forming apparatus is eliminated for up to 24 days after formation of the first layer.

14. The delivery member of claim 13, wherein the stabilizing polymer is methylhydrosiloxane-octylmethyl siloxane (MHOMS) copolymer.

15. The delivery member of claim 13, wherein A-zone lateral charge migration (LCM) is prevented when forming an image with the image forming apparatus.

16. The delivery member of claim 13, wherein an image formed with the image-forming apparatus has no streaking visible to the naked eye.

17. The delivery member of claim 13, wherein the stabilizing polymer is polytetradecylmethylsiloxane (pTDMS).

18. The delivery member of claim 17, wherein A-zone lateral charge migration (LCM) is prevented when forming an image with the image forming apparatus.

19. The delivery member of claim 17, wherein an image formed with the image-forming apparatus has no streaking visible to the naked eye.

20. The delivery member of claim 17, wherein an image formed with the image-forming apparatus has no background darkening visible to the naked eye.

* * * * *